US005378958A

United States Patent [19]

van Heeswijk

[11] Patent Number: 5,378,958

[45] Date of Patent: Jan. 3, 1995

[54] CAPPED ELECTRIC LAMP AND CONNECTOR FOR THIS LAMP

[75] Inventor: Johannes A. A. M. van Heeswijk, Eindhoven, Netherlands

[73] Assignee: U.S. Philips Corporation, New York, N.Y.

[21] Appl. No.: 926,069

[22] Filed: Aug. 5, 1992

[30] Foreign Application Priority Data

Mar. 6, 1992 [NL] Netherlands ..... 9200421

[51] Int. Cl.[6] ..... H01J 5/48; H01J 5/50

[52] U.S. Cl. ..... 313/318; 313/51; 439/611; 439/613

[58] Field of Search ..... 313/318, 51; 439/611, 439/613, 236, 579

[56] References Cited

U.S. PATENT DOCUMENTS

| | | | |
|---|---|---|---|
| 1,824,804 | 9/1931 | Douglas | 439/613 |
| 4,959,583 | 9/1990 | Arsena et al. | 313/318 |
| 5,098,314 | 3/1992 | Castagna et al. | 439/579 |
| 5,216,319 | 6/1993 | Van Heeswijk | 313/318 |
| 5,220,235 | 6/1993 | Wakimizu et al. | 313/318 |
| 5,227,690 | 7/1993 | Van Gennip | 313/51 |
| 5,250,872 | 10/1993 | Wakimizu et al. | 313/318 |
| 5,270,610 | 12/1993 | Schoenherr et al. | 313/318 |

FOREIGN PATENT DOCUMENTS

| | | | |
|---|---|---|---|
| 0309041 | 3/1989 | European Pat. Off. . | |
| 0378020 | 7/1990 | European Pat. Off. | 439/579 |
| 2631739 | 11/1989 | France . | |
| 1418000 | 12/1975 | United Kingdom . | |
| 2234628 | 2/1991 | United Kingdom | 313/318 |

*Primary Examiner*—Donald J. Yusko
*Assistant Examiner*—Matthew J. Esserman
*Attorney, Agent, or Firm*—Brian J. Wieghaus

[57] ABSTRACT

The capped electric lamp has a lamp cap with a central cavity which provides access to a first contact member, a first portion of the lamp vessel being fixed in this cavity. A second conductor is connected to a second contact member separate opening. The first contact member is centrally positioned, the second contact member is positioned on a concentric cylinder. The lamp cap has projections for fixation of a connector. A connector for the lamp has a central first contact and a second contact on a cylinder concentric therewith, as well as a fixing device for cooperating with the lamp cap for the purpose of fixation. The connector may be coupled to the lamp cap in several relative rotational positions.

31 Claims, 2 Drawing Sheets

CAPPED ELECTRIC LAMP AND CONNECTOR FOR THIS LAMP

BACKGROUND OF THE INVENTION

The invention relates to a capped electric lamp which includes a lamp vessel having a first and a second mutually opposing neck-shaped portions with seals through which a first and a second current supply conductor, respectively, extend to an electric element arranged in the lamp vessel;

a metal clamping member which clamps around the first neck-shaped portion of the lamp vessel;

a metal fixation member provided with first tongues which are connected to the clamping member;

a lamp cap of insulating material connected to the lamp vessel and having at a side facing the lamp vessel a first, circumferential cavity in which the fixation member is fixed and a second, central cavity in which the first neck-shaped portion is accommodated, which central cavity affords access to a side of the lamp cap facing away from the lamp vessel where the tamp cap supports a first and a second contact member to which the first and the second current supply conductor, respectively, are connected, the lamp cap at its side facing the lamp vessel having an opening providing access to the side facing away from the lamp vessel, separated from the second cavity, through which opening a connection conductor extends from the second contact member alongside the lamp vessel to the second current supply conductor.

The invention also relates to a connector for this lamp.

Such a lamp in which the electric element is a pair of electrodes is described in the not previously published European Patent Application 91.202.390, now U.S. Pat. No. 5,216,319 (Van Heeswijk). The lamp is designed for use as a vehicle headlamp.

To render it possible to ignite such a lamp while it is still hot, not only a high voltage of several kV is used, but also a high frequency of several kHz.

Owing to its high brightness, the lamp renders it possible to use a headlight of very small height, for example 5 cm. If the lamp is to be accommodated therein, however, it must be of a compact construction.

In the electric discharge lamp described in the said Patent Application, the fixation member does not pass current. However, insulated cables issue from the lamp cap to the exterior, which cables may be connected to a supply source by means of, for example, welding. A disadvantage of this is that a defective lamp cannot be replaced without tools.

EP 0.309.041 A discloses a high-pressure discharge lamp of the kind described in the opening paragraph destined for use as a vehicle headlamp, in which the fixation member passes current. The lamp cap is provided with contact pins in an asymmetrical configuration.

The compact construction of the lamp known from said EP 0.309.041 and the high voltages applied with their high frequencies may cause damaging and disadvantageous electrical effects, such as corona discharges, owing to which the voltage across the lamp can drop and materials of the lamp can be attacked. As a result, breakdown may occur in the course of time. These effects do not occur at low frequencies, for example below 100 Hz, with the other voltage and geometry conditions remaining the same.

The known lamp can be replaced without tools in case of a defect, but it is difficult to provide a connector. Often there is little room behind the headlights in vehicles, and it is difficult to see in what position the connector is to be provided on an inserted lamp.

SUMMARY OF THE INVENTION

It is an object of the invention to provide a capped electric lamp of the kind described in the opening paragraph which is of a simple and reliable construction and which renders the replacement by a new lamp and the electrical connection of the latter to a supply source easy. Another object of the invention is to provide a connector for use with this lamp.

According to the invention, this object is achieved in that the lamp cap has as the first contact member a centrally positioned cylindrical element and the second contact member is accommodated on a cylinder concentric with the former, while means are present for fixing a connector on the lamp cap.

The geometry of the contact members renders it possible to place a connector on the lamp cap in a large number of rotational positions. It is favorable in this case when the means for fixing the connector comprise a circumferential groove or projection with which projections or hooks at the connector can cooperate. It is alternatively possible for the lamp cap to have projections, for example elastic projections, which can snap into a circumferential groove or behind a circumferential projection of a connector.

The electric element may be an incandescent body in an inert gas and comprising a halogen. Such an incandescent body can have a high brightness combined with a satisfactory life if the gas has a high pressure during operation, for example, a few tens of bar. In that way the said lamp can also give a light beam of good quality with a reflector of small dimensions. A compact construction of the lamp is accordingly desirable. Embodiments of the electric lamp according to the invention, however, are also very suitable for the use of a pair of electrodes in an ionizable gas as the electric element.

It is favorable if the first contact member is surrounded by a circumferential collar at the lamp cap. This collar may serve as a carrier for the second contact member. The latter may be, for example, recessed into an exterior surface of the collar. The collar is also useful for spatially separating the two contact members from one another, which is important when high voltages and high frequencies are used. It is convenient when the second contact member is a cylindrical ring with a longitudinal groove in which the connection conductor is fastened. The ring may be formed from strip material, the groove being a fold in this strip. The fold and an overlap in the strip where it is welded for forming the ring may be recessed into the collar so as to provide a fixation against rotation.

In a favorable embodiment, the lamp cap carries a screen cap at its side facing the lamp vessel. The screen cap may become narrower towards the lamp vessel, for example stepped or tapering, if this is necessary for remaining outside the beam path of the light generated by the lamp towards the reflector of a headlamp lantern. Alternatively, however, the screen cap may be a fiat disc, for example of ceramic material, for example of steatite. It screens the lamp cap at least for the major part against radiation generated by the lamp, such as UV, IR and visible radiation.

The connector for use on the lamp cap of the capped electric lamp has a housing of insulating material provided with a cavity with a central first contact accommodated therein and a second contact on a cylinder concentric therewith, as well as means for cooperating with means at the lamp cap so as to fix the connector.

It is favorable if the first contact of the connector is enclosed by a circumferential wall within the cavity. When being provided on the lamp cap, said wall can then be accommodated inside the circumferential collar at the lamp cap and separate the first contact and the first contact member from the second contact and the second contact member by means of a relatively long air path. Charge flashover is rendered difficult by this.

In an embodiment, the second contact has several elastic tongues. This provides a high degree of certainty that a good contact with the second contact member of the lamp cap is obtained, also if one tongue should make a less good contact, for example, owing to an irregularity in the surface.

Since there is usually little space behind the headlights in a vehicle, it is favorable if a cable to which the connector is coupled enters the connector laterally. The cable may approach the lamp cap from various directions. For a lamp inserted on the left in a vehicle this direction may be other than that for a lamp inserted on the right in the vehicle. It is favorable if the connector can be provided on the lamp cap in several rotational positions, not only on account of the ease of providing a connector on a lamp cap, but also on account of the possibility of using cables which are as short as possible.

In a favorable embodiment, the lamp cap has a first and a second lateral projection forming means for fixing the connector, and the housing of the connector has several pairs of mutually opposing grooves provided in elastic portions for accommodating projections of the lamp cap for fixation purposes. The elastic portions may be created, for example, by means of a locally smaller material thickness or by incisions separating a portion from its surroundings. Favorable are L-shaped slots. Such slots may have a narrowed portion behind which a projection is locked. Given two pairs of L-shaped slots, it is already possible to bring a connector into electrical contact with the lamp cap and to fix it mechanically in four rotational positions. It is favorable to form the L-shaped grooves in such a way that, when the connector is passed over the lamp cap, the translational movement performed during this changes as it were naturally into a rotational movement.

To avoid the risk of flashover when high voltages are used, possibly at high frequencies, it is favorable when the housing of the connector has a first and a second chamber facing away from the cavity, said chambers being closed with a cover, in which chambers a connection portion of a respective contact is accommodated to which a respective cable is electrically connected, entering the relevant chamber alongside the cover.

The lamp cap and the connector may consist, for example, of a synthetic resin, for example, a thermoplastic synthetic resin such as a resin chosen from among polyether imide, polyether sulphon, polyphenylene sulphide, polyether ketone, polypropylene oxide, polyamide imide, polyimide, polybutylene terephthalate, which may be charged with powdery or fibrous substances such as, for example, glass or chalk.

BRIEF DESCRIPTION OF THE DRAWINGS

An embodiment of the electric lamp according to the invention and of the connector for this lamp is shown in the drawings, in which.

DESCRIPTION OF THE PREFERRED EMBODIMENTS

Figure 1:
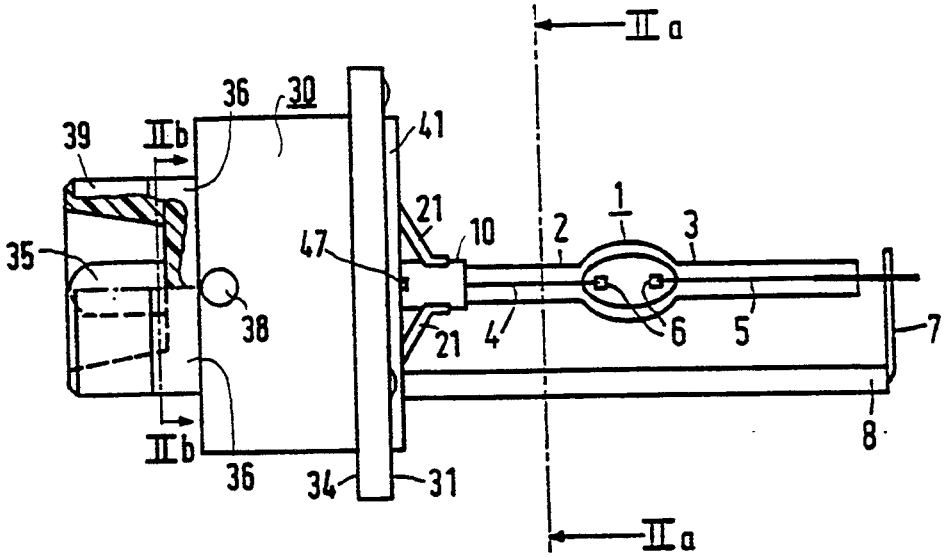
FIG. 1 shows a lamp in side elevation, partly broken away.

In FIG. 1, the capped electric lamp has a lamp vessel 1 with mutually opposing first and second neck-shaped portions 2 and 3, respectively, with seals. A first 4 and a second 5 current supply conductor run through these seals to an electric element 6 arranged in the lamp vessel, in the Figure a pair of electrodes in an ionizable gas. A metal clamping member 10 (see FIG. 3) is present around the first neck-shaped portion 2 of the lamp vessel 1 with clamping fit. A metal fixation member 20 (see FIG. 3) provided with first tongues 21 is connected to the clamping member 10 by means of said tongues. The lamp has a lamp cap 30 of insulating material which is connected to the lamp vessel 1. The lamp cap has at a side 31 (see FIG. 2*a*) facing the lamp vessel a first circumferential cavity 32 in which second tongues 22 keep the fixation member 20 fixed, and a second central cavity 33 in which the first neck-shaped portion 2 is accommodated. This central cavity affords access to a side 34 of the lamp cap 30 facing away from the lamp vessel 1, where the lamp cap carries a first 35 and a second contact member 36 to which the first 4 and the second current supply conductor 5, respectively, are connected. The lamp cap 30 has an opening 37 with access to the side 34 facing away from the lamp vessel and separated from the second cavity 33 at its side 31 facing the lamp vessel. It is visible in FIG. 2*a* that the opening 37 also lies outside the first cavity 32. A connection conductor 7 extending from the second contact member 36 to the second current supply conductor 5 is passed through this opening 37. This conductor 7 is surrounded by an insulating body 8, for example made of $Al_2O_3$ or steatite, which enters the opening 37, in the Figure laterally of the lamp vessel 1. Alternatively, the conductor 7 may be coated with an insulator, for example, a layer of $ZrO_2$ or $Al_2O_3$. The fixation member 20 (FIG. 3) has second tongues 22 with free ends 23 which are bent back alongside the fixation member 20 so as to point towards the lamp vessel 1, and which lie with their free ends 23 in the first cavity with clamping fit.

The lamp cap 30 has a centrally placed cylindrical element as the first contact member 35. The second contact member 36 is placed on a cylinder concentric therewith. Means 38 are present for fixing a connector on the lamp cap. In the Figure, the first contact member 35 is a hollow bush which was broken open at its top for passing the first current supply conductor 4 through it and connecting this conductor to the bush by means of a weld, for example, by arc welding.

The first contact member 35 is surrounded by a circumferential collar 39 at the lamp cap 30, into whose exterior surface the second contact member 36 is recessed. The second contact member 36 in the embodiment drawn is a cylindrical ring with a longitudinal groove 45 in which the connection conductor 7 is fastened. This contact member is made from strip material and closed on an overlap 46 (FIG. 2*b*).

The means for fixation of a connector comprise a first and a second lateral projection 38.

The lamp cap has a screen cap 41 in the shape of a flat ceramic disc which is fixed by means of ultrasonically deformed pins 47.

Figure 2A:
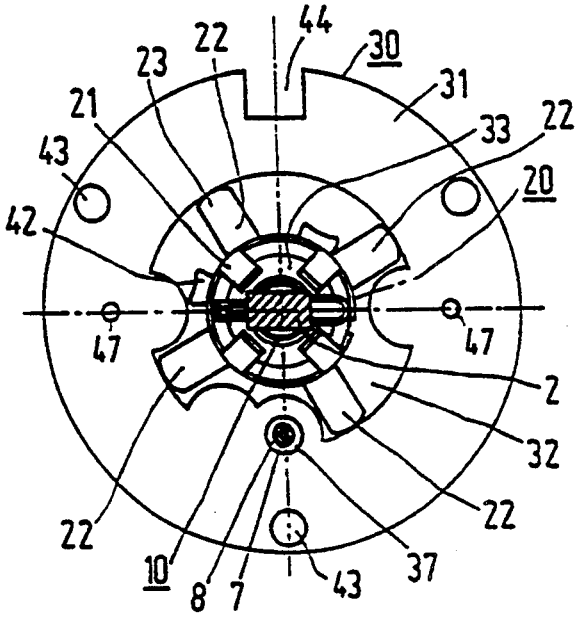
FIG. 2*a* is a cross-section taken on the line IIa—IIa in FIG. 1 with the screen cap 41 taken away.
Figure 2B:
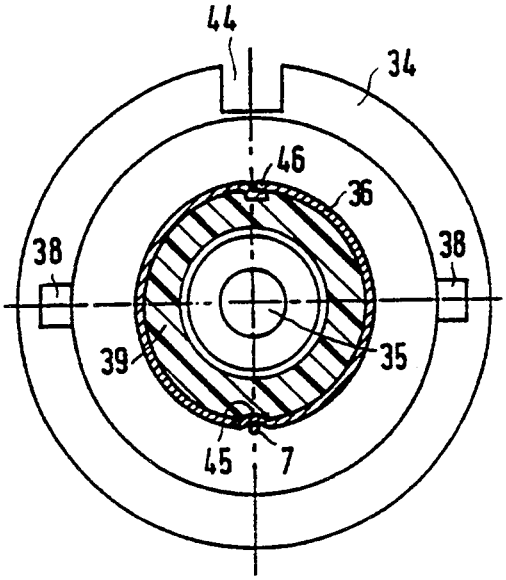
FIG. 2*b* is a cross-section taken on the line IIb—IIb in FIG. 1.

In FIG. 2*a*, the fixation member 20 in the first circumferential cavity 32 of the lamp cap 30 is visible with the free ends 23 of its second tongues 22 in the first circumferential cavity 32. The cavity is shaped so as to limit rotation of the fixation member 20. The first cavity 32 has a recess 42 in which a third tongue 24 (see FIG. 3) of the fixation member is enclosed. Reference locations 43 and a recess 44 serve as a lock against rotation and determine the position of the lamp in a reflector of a headlight of a vehicle. The pair of electrodes 6 (FIG. 1) is aligned in relation thereto.

Figure 3:
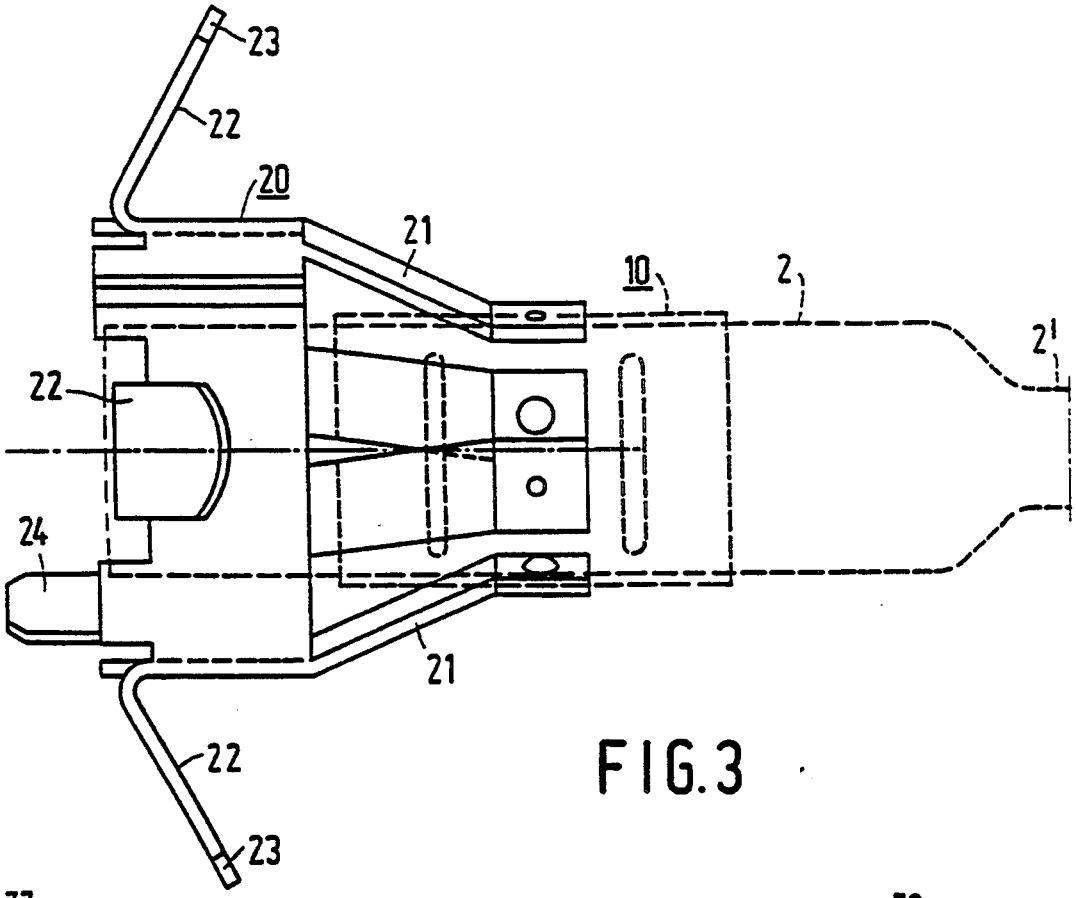
FIG. 3 shows the fixation member of the lamp of FIG. 1 in side elevation.

In FIG. 3, the clamping member 10 and the first neck-shaped portion 2 with the seal 2' of the lamp vessel 1 are indicated diagrammatically. The first tongues 21 (FIG. 1) lie substantially entirely outside the first cavity 32 so as to be accessible for making welded joints at the clamping member 10. The clamping member 10 is a tubular body.

Figure 4A:
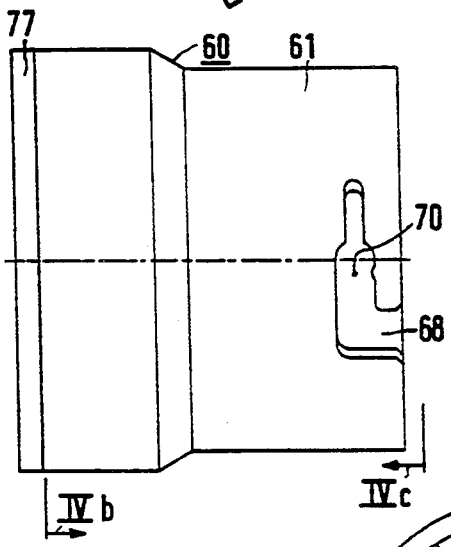
FIGS. 4*a, b, c* show a connector in side elevation and in elevation along the lines IVb and IVc in FIG. 4*a*, respectively.
Figure 4B:
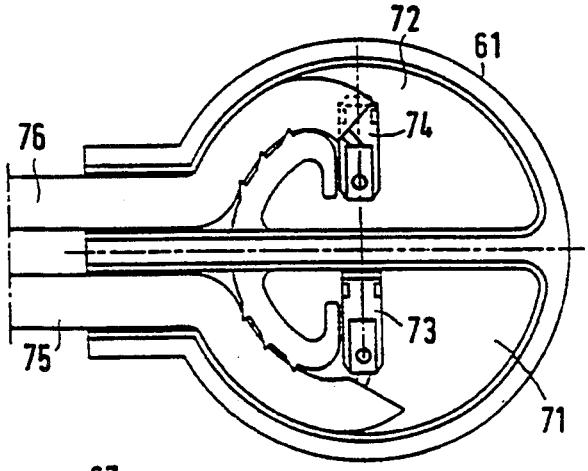
Figure 4C:
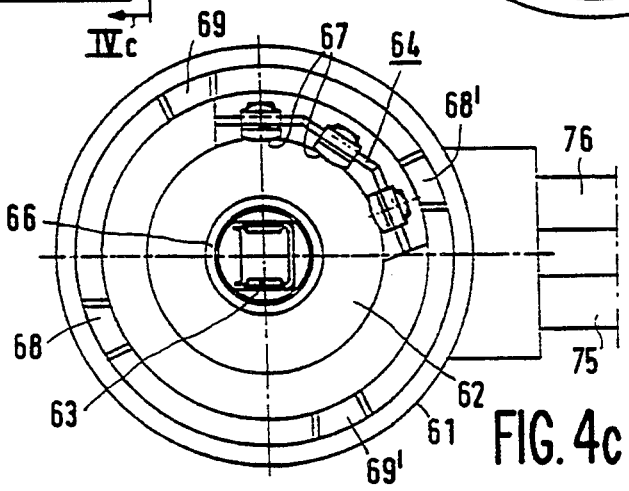

In FIGS. 4*a, b, c,* the connector 60 for use on the lamp cap 30 of the capped electric lamp has a housing 61 of insulating material provided with a cavity 62 with a first contact 63 centrally accommodated therein and, on a cylinder concentric therewith, a second contact 64, and in addition means 68, 69 for cooperating with means at the lamp cap for fixation of the connector.

The first contact 63 is surrounded by a circumferential wall 66 inside the cavity 62 so as to be enclosed by the circumferential collar 39 at the lamp cap. The second contact 64 has several elastic contact tongues 67.

The housing 61 is provided with several pairs 68, 68'; 69, 69' of mutually opposing grooves 68, 68', 69, 69' located in elastic portions for accommodating projections 38 of the lamp cap 30 for the purpose of fixation. The grooves in the embodiment shown are L-shaped slots. They each have a narrowed portion 70 behind which a projection can be locked and a widened insertion opening for affording projections easy access.

The housing 61 has a first 71 and a second chamber 72, closed with a cover 77, remote from the cavity 62, in which chambers connection portions 73, 74 of respective contacts 63, 64, are accommodated, by means of which respective cables 75, 76 entering the relevant chambers alongside the cover 77 are electrically connected. The cover 77 is ultrasonically connected to the chamber walls in order to separate these chambers from one another.

The capped electric lamp according to the invention, for example the capped electric discharge lamp of FIG. 1, and the connector for use on the lamp cap of this capped electric lamp, for example the connector of FIG. 2, according to the invention are capable of forming an assembly. The combination is suitable for use in conjunction with a vehicle headlight.

I claim:

1. A capped electric lamp, comprising:

a) a lamp vessel having a first and a second mutually opposing neck-shaped portion with seals, an electric element arranged in the lamp vessel, a first and a second current supply conductor, respectively, each connected to the electric element and extending through a respective seal;

b) a metal clamping member which clamps around the first neck-shaped portion of the lamp vessel;

c) a metal fixation member having first tongues which are connected to the clamping member;

d) a lamp cap of insulating material connected to the lamp vessel and having a side facing the lamp vessel and a side facing away from the lamp vessel, at the side facing the lamp vessel said lamp cap having (i) a first, circumferential cavity in which the fixation member is fixed, (ii) a second, central cavity in which the first neck-shaped portion is accommodated, which central cavity communicates with the side of the lamp cap facing away from the lamp vessel, and (iii) a further opening providing access to the side facing away from the lamp vessel, separated from the second central cavity;

e) a centrally positioned cylindrical contact pin extending from the second, central cavity in the direction away from the lamp vessel;

f) a second, annular contact extending from the side of the lamp cap facing away from the lamp vessel along the length dimension of the contact pin, said annular contact surrounding said contact pin and being radially spaced therefrom;

g) a connection conductor extending from the annular contact alongside the lamp vessel through the further opening to the second current supply conductor; and h) means for fixing a connector on the lamp cap.

2. A capped electric lamp as claimed in claim 1, characterized in that the contact pin is surrounded by an annular collar at the lamp cap, the annular collar having an exterior surface facing away from the contact pin in which the annular contact is recessed.

3. A capped electric lamp as claimed in claim 2, characterized in that the annular contact member is an annular ring with a longitudinal groove in which the connection conductor is fastened.

4. A capped electric lamp as claimed in claim 3, characterized in that the means for fixation of a connector comprise a first and a second lateral projection.

5. A capped electric lamp as claimed in claim 4, characterized in that the electric element is a pair of electrodes.

6. A connector for connection to an electric lamp having a lamp cap with a first, central cylindrical contact pin, a second annular contact arranged at the same axial location as the first contact pin which surrounds the first contact pin, and a lateral projection, said connector comprising:

a housing of insulating material having a cavity with a first connector contact centrally accommodated therein for receiving substantially the entire length of the contact pin of the lamp cap and a second connector contact arranged at the axial location of the first connector contact and provided on a cylinder concentric therewith for contacting the second annular contact, and fixation means for cooperating with the lateral projection at the lamp cap for detachable fixation of the connector.

7. A connector as claimed in claim 6, wherein for a lamp cap having an annular collar around the first contact pin, said connector includes a circumferential wall inside the connector cavity so as to be enclosed by the annular collar at the lamp cap when the connector is mated with thee lamp cap.

8. A connector as claimed in claim 7, characterized in that the second connector contact comprises several elastic contact tongues.

9. A connector as claimed in claim 8, characterized in that the housing has elastic portions and several pairs of mutually opposing grooves located in the elastic portions for accommodating projections of the lamp cap for the purpose of fixation.

10. A connector as claimed in claim 9, characterized in that the grooves are L-shaped slots.

11. A connector as claimed in claim 10, characterized in that the slots each have a narrowed portion behind which a projection of the lamp cap can be locked.

12. A connector as claimed in claim 11, characterized in that the housing has a first and a second chamber, closed by a cover, remote from the cavity, in which chambers connection portions of contacts are accommodated by which respective cables are electrically connected, these cables entering the first and second chambers, respectively alongside the cover.

13. A capped electric lamp as claimed in claim 2, characterized in that the means for fixation of a connector comprise a first and a second lateral projection.

14. A capped electric lamp as claimed in claim 1, characterized in that the means for fixation of a connector comprise a first and a second lateral projection.

15. A capped electric lamp as claimed in claim 1, characterized in that the electric element is a pair of electrodes.

16. A connector as claimed in claim 6, characterized in that the second contact comprises several elastic contact tongues.

17. A connector as claimed in claim 16, characterized in that the housing has elastic portions and several pairs of mutually opposing grooves located in the elastic portions for accommodating projections of the lamp cap for the purpose of fixation.

18. A connector as claimed in claim 7, characterized in that the housing has elastic portions and several pairs of mutually opposing grooves located in the elastic portions for accommodating projections of the lamp cap for the purpose of fixation.

19. A connector as claimed in claim 6, characterized in that the housing has elastic portions and several pairs of mutually opposing grooves located in the elastic portions for accommodating projections of the lamp cap for the purpose of fixation.

20. A connector as claimed in claim 10, characterized in that the housing has a first and a second chamber, closed by a cover, remote from the cavity, in which chambers connection portions of the first and second lamp contacts are accommodated by which respective cables are electrically connected, these cables entering the first and second chambers, respectively, alongside the cover.

21. A connector as claimed in claim 9, characterized in that the housing has a first and a second chamber, closed by a cover, remote from the cavity, in which chambers connection portions of the first and second lamp contacts are accommodated by which respective cables are electrically connected, these cables entering the first and second chambers, respectively, alongside the cover.

22. A connector as claimed in claim 8, characterized in that the housing has a first and a second chamber, closed by a cover, remote from the cavity, in which chambers connection portions of the first and second lamp contacts are accommodated by which respective cables are electrically connected, these cables entering the first and second chambers, respectively, alongside the cover.

23. A connector as claimed in claim 7, characterized in that the housing has a first and a second chamber, closed by a cover, remote from the cavity, in which chambers connection portions of the first and second lamp contacts are accommodated by which respective cables are electrically connected, these cables entering the first and second chambers, respectively, alongside the cover.

24. A connector as claimed in claim 6, characterized in that the housing has a first and a second chamber, closed by a cover, remote from the cavity, in which chambers connection portions of the first and second lamp contacts are accommodated by which respective cables are electrically connected, these cables entering the first and second chambers, respectively, alongside the cover.

25. The combination of a capped electric lamp and connector therefor, comprising:

a) an electric lamp comprising (i) a light source which is energizeable for emitting light, (ii) a lamp cap holding said light source, said lamp cap including a body of insulative material having a side facing said light source and a side facing away from said light source, at said side facing away from said light source said lamp cap includes a first central contact member with a length dimension, an annular collar of the insulative material surrounding said central contact member over substantially its entire length, said collar being radially spaced from said first contact member, having an inner side facing said first contact member and a second face facing away from said first contact member, and a second, annular contact at said second face axially positioned along said first contact member and separated from said first contact member by said annular collar and the space between said annular collar and said first contact member, and (iii) means for electrically connecting said first and second contacts to said light source; and b) a connector for connection to said lamp cap, said connector including a housing of insulative material having a recess for receiving said annular collar of said lamp cap, a first connector contact positioned centrally within said cavity for contacting said central contact of said lamp cap, a second connector contact positioned at the periphery of said recess for contacting said second, annular contact of said lamp cap, a pair of power supply cable connection terminals, and means for connecting each of said cable connection terminals to a respective one of said first and second connector contacts, said connector and lamp cap contacts being arranged such that with said lamp cap collar received in said recess of said housing said connector contacts contact said lamp cap contacts in a plurality of rotational positions of said connector housing relative to said lamp cap; and c) said connector housing and said lamp cap body comprise securing means for removably securing said connector housing to said lamp cap in a plurality of said rotational positions.

26. The combination according to claim 25, wherein said securing means includes a plurality of L-shaped slots and a plurality of projections by which said connector is removably securable to said lamp cap by an axial and a rotational movement of the connector and lamp cap relative to each other.

27. The combination according to claim 26, wherein said connector comprises said L-shaped slots and said lamp cap comprises said projections.

28. The combination according to claim 25, wherein said connector housing includes a wall separating said connector contacts from said cable connection terminals.

29. The combination according to claim 25, wherein said second connector contact comprises a plurality of elastic tongues.

30. An electric lamp, comprising:

(a) a light source which is energizeable for emitting light;

(b) a lamp cap holding said light source, said lamp cap including a body of insulative material having a side facing said light source and a side facing away from said light source, at said side facing away from said light source said lamp cap includes (i) a first central contact member extending with a length dimension and terminating at a distal end, (ii) an annular collar of said insulative material which surrounds said central contact member over substantially its entire length, said collar being radially spaced from said central contact member, having an inner side facing said first contact member which defines an annular, contact-receiving space about said first contact member extending from said distal end to side facing away from said first contact member, and (iii) a second, annular contact at said second side axially positioned along said first contact member and separated from said first contact member by said annular collar and the annular space between said annular collar and said first contact member;

(c) means for electrically connecting said first and second contacts to said light source; and (d) means for fixing a connector, having first and second connector contacts, on said lamp cap in a plurality of rotational positions with the first connector contact received in said annular space and in contact with said first central contact member and the second connector contact in contact with said second annular contact.

31. An electric lamp according to claim 29, wherein:

said first, central contact is an elongate pin;

said light source is a high pressure discharge lamp arc tube in which a gas discharge is maintained during lamp operation, said arc tube including a pair of opposing elongate neck shaped seals defining a lamp axis;

said lamp cap includes means for holding a said seal with said arc tube positioned with said other seal directed away from said lamp cap and with said lamp axis aligned with said elongate pin.

* * * * *